US006931693B2

(12) United States Patent
Uemura

(10) Patent No.: US 6,931,693 B2
(45) Date of Patent: Aug. 23, 2005

(54) DAMPER MECHANISM

(75) Inventor: Kyosuke Uemura, Tokyo (JP)

(73) Assignee: E. I. du Pont de Nemours and Company, Wilmington, DE (US)

( * ) Notice: Subject to any disclaimer, the term of this patent is extended or adjusted under 35 U.S.C. 154(b) by 3 days.

(21) Appl. No.: 10/363,967

(22) PCT Filed: Sep. 10, 2001

(86) PCT No.: PCT/US01/28307

§ 371 (c)(1),
(2), (4) Date: Mar. 6, 2003

(87) PCT Pub. No.: WO02/23001

PCT Pub. Date: Mar. 21, 2002

(65) Prior Publication Data

US 2004/0016613 A1 Jan. 29, 2004

(30) Foreign Application Priority Data

Sep. 11, 2000 (JP) ..... 2000-275249

(51) Int. Cl.[7] ..... E05F 5/10
(52) U.S. Cl. ..... 16/85; 16/65; 16/84; 16/377
(58) Field of Search ..... 16/70, 85, 66, 16/49, 84, 65, DIG. 10, DIG. 21, DIG. 17, 374, 375, 377

(56) References Cited

U.S. PATENT DOCUMENTS

| | | | | | |
|---|---|---|---|---|---|
| 266,795 | A | * | 10/1882 | Elliot | 16/70 |
| 942,656 | A | * | 12/1909 | Moore | 16/49 |
| 1,254,024 | A | * | 1/1918 | Bryan | 417/513 |
| 1,344,538 | A | * | 6/1920 | Kaufman | 16/305 |
| 1,678,817 | A | | 7/1928 | Kingman | |
| 1,965,806 | A | * | 7/1934 | Riggins | 16/52 |
| 2,841,813 | A | * | 7/1958 | Falk | 16/66 |
| 4,524,438 | A | * | 6/1985 | Einhaus | 369/75.1 |
| 4,760,621 | A | * | 8/1988 | Stromquist | 16/85 |
| 6,321,412 | B1 | * | 11/2001 | Duco | 16/85 |

FOREIGN PATENT DOCUMENTS

| | | |
|---|---|---|
| GB | 650925 | 3/1951 |
| GB | 838094 | 6/1960 |

* cited by examiner

*Primary Examiner*—Chuck Mah
*Assistant Examiner*—Michael J. Kyle

(57) ABSTRACT

A damper mechanism installed on an opening and closing device that has an arcuate plunger with the same radius of curvature of the cylinder it slidably mates with. A torsion coil spring causes the sliding action of the plunger into the cylinder in one direction.

5 Claims, 3 Drawing Sheets

DAMPER MECHANISM

This application references and claims the benefit of priority of the Japanese Patent Application No. 2000/275249, filed Sep. 11, 2000 and Japanese Patent Application No. 2000/275249 is herein incorporated by reference.

BACKGROUND OF THE INVENTION

1. Field of the Invention

The present invention relates to a damper mechanism that is installed as an accessory on an opening and closing member, such as a door or cover, which turns about a given axis of rotation.

2. Description of the Prior Art

When a door, cover or other opening and closing member which uses hinges is rotated or moved in one direction, such as the closing direction, and the member is automatically closed by such a rotating force, it is common practice to incorporate a damper mechanism which makes the member turn slowly to ensure the safety of the opening and closing movement and to ease the impact at the time of closure.

The simplest construction in prior-art damper mechanisms used for such a purpose is a single-action damper mechanism having a tubular, closed cylinder and a piston which fits inside the cylinder in a freely slidable manner and divides the interior of the cylinder into two chambers. The two chambers are made to communicate via an orifice provided in the piston. An urging member, such as a coil spring, which forces the piston in a first sliding direction is provided within one of the two chambers. In addition, a pressure-regulating valve which regulates the opening of the orifice according to the sliding direction of the piston is provided within the orifice. The pressure-regulating valve controls fluid pressure against the piston resisting the applied force. The base of the cylinder and the tip of the piston rod are respectively connected to a stationary side (which is a structure for receiving an opening and closing member) and a movable side (e.g. an opening and closing member such as a door). Generally, the coil spring acts to close the opening and closing member, in which state the pressure-regulating valve narrows the orifice, thereby slowly closing the member and suppressing the sound of impact at the time of closure.

In prior-art damper mechanisms, the piston which slides through the cylinder carries out linear motion. As a result, when the damper mechanism is mounted directly on an opening and closing member, it is inherently impossible to maintain a proportional relationship between the urging (e.g. applied) force by the damper mechanism and the degree of turning by the opening and closing member. Moreover, such a damper mechanism does not readily allow the member to be turned through a large angle, thus necessitating the installation of some kind of linking mechanism to facilitate opening and closing.

Prior-art damper mechanisms thus have a large number of parts, resulting in a high weight and high production costs. In addition, maintenance (e.g. maintainability) of prior art damper mechanisms is a problem due to the many moving parts.

It is desirable to provide a simple and convenient damper mechanism which can minimize the number of parts and has good maintainability.

SUMMARY OF THE INVENTION

Briefly stated, and in accordance with one aspect of the present invention, there is provided a damper mechanism having a cylinder which is open at a first end and closed at a second end and which describes an arc having a predetermined radius of curvature; an arcuate plunger of the same radius of curvature as the cylinder, a first end of the plunger slides within the cylinder in such a manner as to trace an arched path corresponding to the predetermined radius of curvature; a means for urging (e.g. moving) the plunger in one sliding direction relative to the cylinder; a passage provided at the first end of the plunger, the passage connects the interior of the cylinder that is sectioned by the first end of the plunger to the exterior; and a pressure-regulating valve provided in the passage which valve reduces the cross-sectional area of the passage when the plunger moves in the sliding direction and increases the cross-sectional area of the passage when the plunger moves in the opposite direction.

BRIEF DESCRIPTION OF THE DRAWINGS

The invention will be more fully understood from the following detailed description, taken in connection with the accompanying drawings, which form a part of this application and in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

According to the present invention, by mounting the damper mechanism on the opening and closing member so that the movement or turn of the opening and closing member coincides with the center of curvature of the cylinder and plunger, the direction in which the opening and closing member turns is substantially the same as the direction of the force exerted by the urging means (e.g. applied motion), allowing the applied force to be efficiently transferred to the opening and closing member. In this case, the cross-sectional area of the passage is reduced by the pressure-regulating valve, causing the opening and closing member to turn slowly. However, when a force acts upon the opening and closing member in a direction opposite to that of force exerted by the applied motion, the passage cross-sectional area is increased by the pressure-regulating valve so that the opening and closing member turns in accordance with the force acting upon it.

The damper mechanism of the invention can use a torsion coil spring of which respective ends engage a pair of notches formed at a separation of 180 degrees) at one end of the cylinder and one end of the plunger. The 180 degrees occurs between the two notches that are disposed facing each other on the cylinder surface.

In this case, it is preferable for the center of curvature of the cylinder and the plunger to coincide with the center of rotation of the torsion coil spring.

Preferably, the plunger also has formed at the first end thereof a pair of engagement grooves capable of engaging the first end of the torsion coil spring.

The casing (i.e. the body of the cylinder) and plunger may be made of a thermoplastic resin.

The damper mechanism of the invention is described more fully below in conjunction with attached FIGS. 1 to 6, which illustrate an embodiment in which the damper mechanism is installed on an opening and closing cover for an enclosure. It should be noted, however, that the present invention is not limited only to embodiments of this type, and can be applied also to other art encompassed by the concepts set forth in the appended claims.

Figure 1:
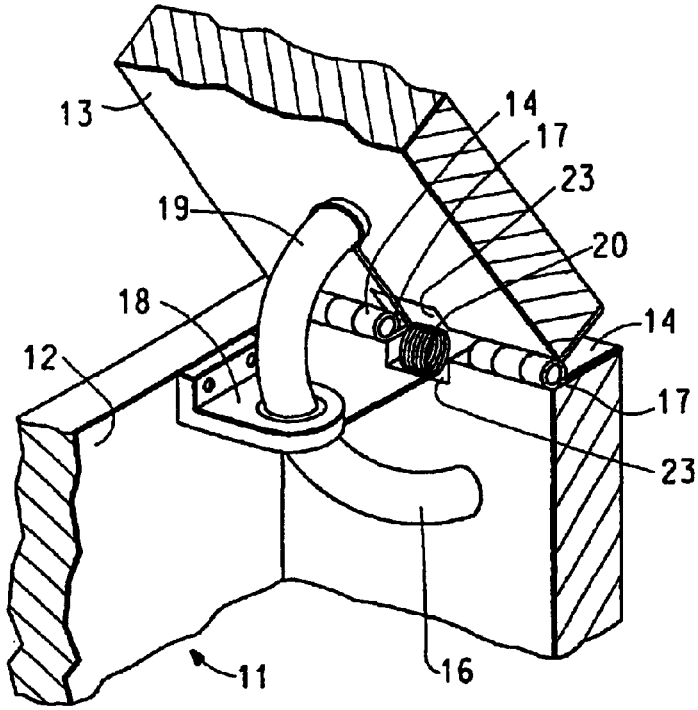
FIG. 1 is a perspective view showing one embodiment of the invention in which the damper mechanism has been installed on the cover of a housing.
Figure 2:
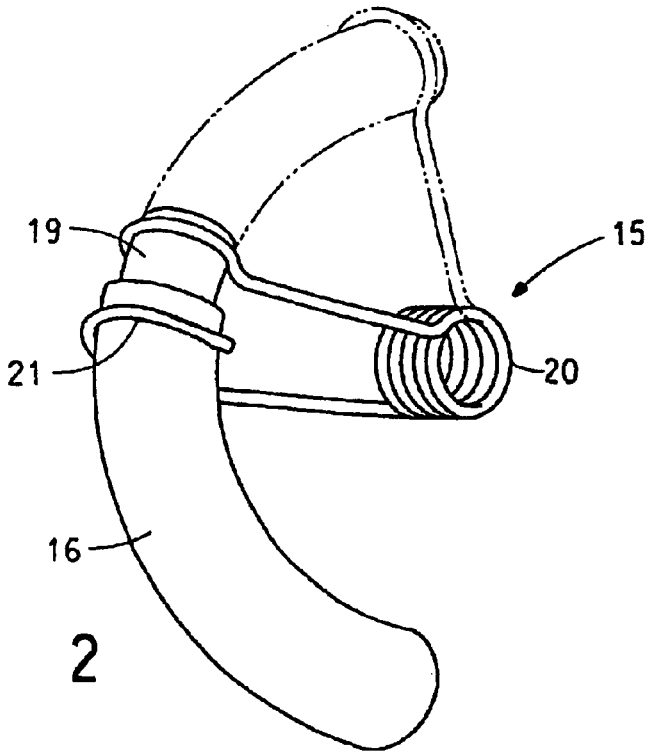
FIG. 2 is a perspective view showing the same damper mechanism by itself.

FIG. 1 is a perspective view showing the damper mechanism of the present embodiment after it has been installed. FIG. 2 shows the same damper mechanism by itself. A box-like housing 11 has an open end 12 on which a cover 13, which is capable of opening and closing the open end 12 and serves as the opening and closing member of the invention, is pivotally attached via a plurality of hinges 14. A catch (not shown) which, when engaged, keeps the cover 13 shut is provided between the cover 13 and the housing 11. Releasing the catch from its state engagement allows the cover 13 to be opened.

The damper mechanism 15 of the present embodiment is mounted between the housing 11 and the cover 13 and functions so that, when the catch is released from its state of engagement, the cover 13 slowly opens.

The damper mechanism 15 includes a cylinder 16 which is of circular cross-section and describes an arc having a predetermined radius of curvature; a mounting bracket 18 which is provided integral with the cylinder 16 for attaching the cylinder 16 to the housing 11 such that the cylinders's center of curvature is concentric with the pivots 17 of the hinges 14; a plunger 19 which is of circular cross-section, describes an arc having the same radius if curvature as the cylinder 16, and the base end of which mates slidably with the cylinder 16 is such a manner as to trace an arched path corresponding to the specific radius of curvature; and, as the moving means of the invention, a torsion coil spring 20 which causes the plunger 19 to protrude from the cylinder 16. This construction enables the cover 13 to move or rotate automatically from a closed state to an approximately 70-degree open state. Preferably, the outside diameter of the plunger 19 relative to the inside diameter of the cylinder 16 in which it is inserted allows for a suitable gap therebetween of about 0.2 mm when mated. Where necessary, it may be effective to place an O-ring in the gap between the cylinder 16 and the plunger 19.

Figure 3:
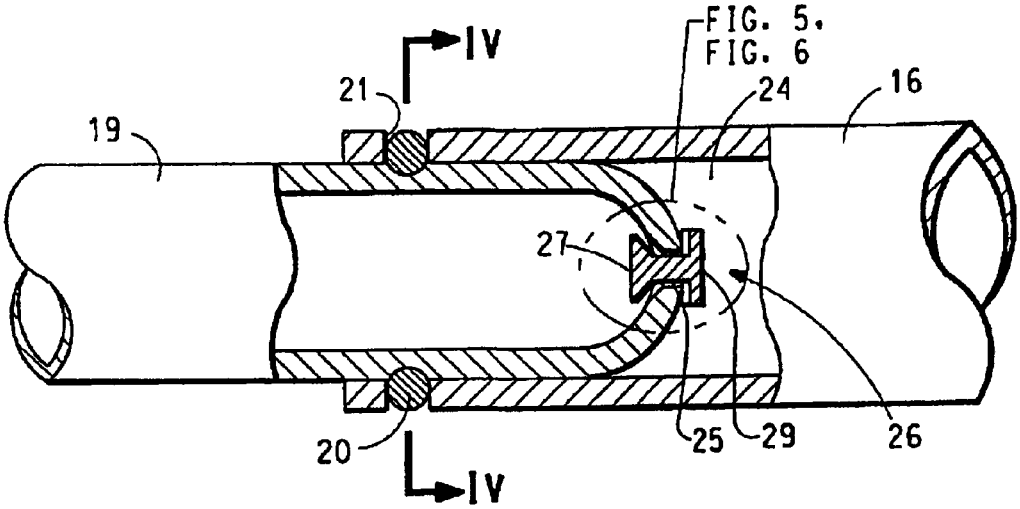
FIG. 3 is a sectional view showing the construction of the major features in the same damper mechanism.
Figure 4:
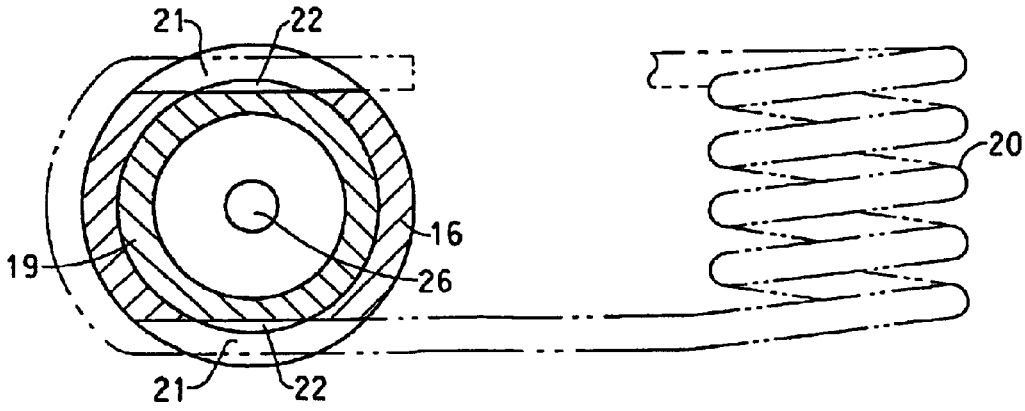
FIG. 4 is a sectional view taken along line IV—IV in FIG. 3.

FIG. 3 is a sectional view showing the construction of the mating area between the cylinder 16 and the plunger 19, and FIG. 4 is sectional view taken along line IV—IV in FIG. 3. One end of a torsion coil spring 20 is fixedly coupled to the tip of the plunger 19 which presses against the cover 13. A second end of the spring 20 engages, or clamps, from either side a pair of parallel notched grooves 21 which face each other along the central axis of curvature of the cylinder 16 and the plunger 19, and each of which extends toward the central axis of curvature. The center portions of these notched grooves 21 open into the cylinder 16. That is, the thickness of the notched grooves 21 is made somewhat larger than the wall thickness of the cylinder 16 so that the plunger 19 slides within the cylinder 16 with the second end of the torsion coil spring 20 pressing against a portion of the plunger periphery at the base end thereof. Moreover, the base end of the plunger 19 has formed thereon a pair of engagement grooves 22 which face the interior of the cylinder 16 and are capable of engaging the second end of the torsion coil spring 20 through the foregoing notched grooves 21. These engagement grooves 22, like the notched grooves 21, face each other along the central axis of curvature for the cylinder 16 and the plunger 19 and extend in a mutually parallel fashion toward the central axis of curvature.

Thus, although the force exerted by the torsion coil spring 20 is able to displace the plunger 19 so that it protrudes from the cylinder 16, engagement of the second end of the torsion coil spring 20 with the engagement grooves 22 prevents further outward movement of the plunger 19. Of course, the plunger 19 can be pulled out of the cylinder 16 when a force acts upon the plunger 19 which is larger than the force of engagement associated with the clamping pressure by the second end of the torsion coil spring 20 against the engagement grooves 22. A construction such as this can greatly facilitate assembly of the damper mechanism 15 by insertion of the plunger 19 into the cylinder 16. Moreover, because the second end of the torsion coil spring 20 engages the engagement grooves 22 formed at the base end of the plunger 19, shifts in the rotational position of the plunger 19 relative to the cylinder 16 are corrected whenever the cover 13 is opened and closed. This helps prevent problems such as gouging from minor rotation of the plunger 19 relative to the cylinder 16, and allows the plunger 19 to slide smoothly at all times.

Referring again to FIG. 1, the coil spring portion of the torsion coil spring 20 is received in notches 23 formed in the housing 11 and the cover 13 such that the center of the spring 20 is concentric with the pivots 17 on the hinges 14.

In FIG. 3, the base portion of the plunger 19 which has been received within the cylinder 16 and partitions the interior of the cylinder 16 into a closed damper chamber 24 has formed therein a passage 25 which connects the damper chamber 24 with the exterior via the interior of the plunger 19. A pressure-regulating valve 26 is installed within this passage 25. The valve reduces the cross-sectional area of the passage 25 when the plunger 19 moves out of the cylinder 16 (i.e. by the moving force of the coil spring 20), and increases the passage cross-sectional area when the plunger 19 moves in the opposite direction.

Figure 5:
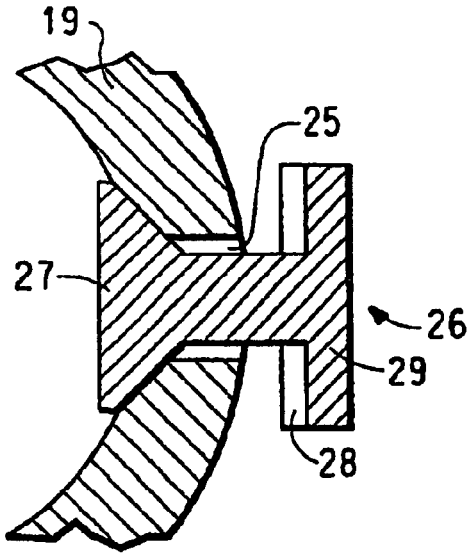
FIG. 5 is an enlarged view of the circled area in FIG. 3 with the passage at its largest cross-section area.

Referring to FIG. 5, the pressure-regulating valve 26 is a type of poppet valve having on the plunger 19 side a conical first valve body 27, and having on the damper chamber 24 (FIG. 3) side a second valve body 29 with a raised area 28 that forms at all times a gap with the end face at the base of the plunger. In this embodiment of the present invention, the valve 26 is formed of a thermoplastic resin, such as Hytrel® polyester elastomer available from DuPont-Toray Co., Ltd. or Zytel® nylon resin available from E.I. DuPont de Nemours and Co. The valve 26 is squeezed and elastically deformed at one end, in which manner it is forcibly inserted into the passage 25. Once inserted, the valve 26 is designed to move back and forth along the passage 25.

Therefore, on manipulating the catch (not shown) so as to release the state of engagement between the cover 13 and the housing 11 when the cover 13 is shut, the plunger 19 emerges from the cylinder 16 under the urging (e.g. force) of the torsion coil spring 20 and acts upon the cover 13 to open it. FIG. 5 shows the condition of the pressure-regulating valve 26 at this time. The pressure difference between the plunger 19 interior which has been held at atmospheric pressure and the interior of the damper chamber 24 which tends to be under reduced pressure moves the pressure-regulating valve 26 toward the damper chamber 24 side so that the passage 25 is placed in a narrowed state by the first valve body 27. This restricts the entry of air into the damper chamber 24, as a result of which the plunger 19 slowly emerges from the cylinder 16 and pushes up the cover 13. Pushing of the cover 13 stops when the second end of the torsion coil spring 20 engages the engagement grooves 22 on the plunger 19. Because the cover 13 is merely in resting contact with the tip of the plunger 19, if there is a need to open the cover 13 further, it can be opened by hand to the extent permitted by the hinges 14.

Figure 6:
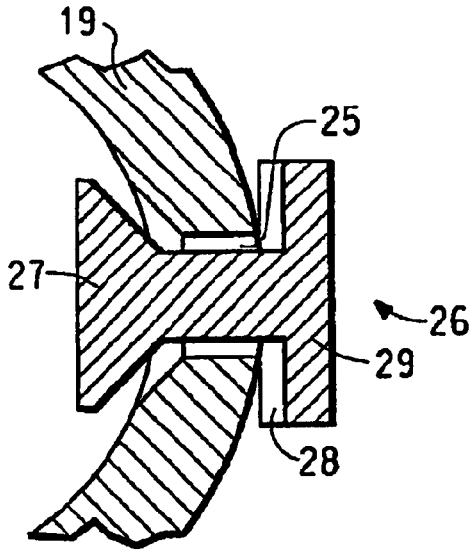
FIG. 6 is an enlarged view of the circled area in FIG. 3 with the passage narrowed to its smallest cross-sectional area.

Conversely, when the cover 13 is closed against the force of the torsion coil spring 20 from an open state, as shown in FIG. 6 which depicts the state of the pressure-control valve 26 at this time, the interior of the damper chamber 24 is compressed and the pressure therein tends to become higher than atmospheric pressure, thereby moving the pressure-control valve 26 to the plunger 19 side. The passage 25 is held open by the raised area 28 of the second valve body 29, so that air inside the damper chamber 24 is discharged from the passage 25, through the interior of the plunger 19, and out to the exterior, thereby allowing the cover to be easily shut by a force applied against the force of the torsion coil spring 20.

The above-described cylinder 16 and plunger 19 are difficult to mass produce from metal due to technical constraints inherent to metal machining processes. However, molds required to shape plastic can be precisely manufactured by numerically controlled machine tools and other suitable equipment. Accordingly, the above-described cylinder 16 and plunger 19 can be precisely made by selecting an appropriate material such as an acetal resin (e.g., Delrin® 500 OP, available from E.I. DuPont de Nemours and Co.).

In the above-described embodiment, the damper function is used when opening the cover 13. However, it is also possible to do the reverse; namely, to use the damper function when shutting the cover 13. It is to be understood that the design of the damper mechanism 15 may be suitably modified according to the particular object on which it is to be used, or the requirements for that object, within the scope of the appended claims.

Because the damper mechanism of the invention has a mating cylinder and a plunger, each with an arcuate shape of the same specific radius of curvature, and the plunger traces an arched path corresponding to the radius of curvature, by mounting the damper mechanism on an opening and closing member so that the center of curvature of the damper mechanism coincides with the turn of the opening and closing member, the direction in which the member turns can be made substantially the same as the direction of the opposing force generated by the damper mechanism. This arrangement allow the invention to provide an efficient damper mechanism having a minimal number of parts.

The urging or moving means may be a torsion coil spring, a first end of which engages with a pair of notches formed at a separation of 180 degrees at one end of the cylinder, and a second end of which is coupled to the other end of the plunger. When the center of curvature of the cylinder and plunger coincides with the center of rotation of the torsion coil spring, the direction in which the opening and closing member turns can be made substantially the same as the direction of the opposing force generated by the damper mechanism, thereby making it possible to provide an efficient damper mechanism having a minimal number of parts.

By providing at one end of the plunger a pair of engagement grooves capable of engaging one end of the torsion spring coil, the movement of one sliding end of the plunger with respect to the cylinder can be restricted such as to prevent the plunger from pulling entirely out of the cylinder.

If the casing and plunger are made of a thermoplastic resin, there is no need for lubrication, making it possible to achieve a maintenance-free lightweight damper mechanism.

It is therefore, apparent that there has been provided in accordance with the present invention, a damper mechanism that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A damper mechanism comprising:

a cylinder which is open at a first end and closed at a second end and which describes an arc having a predetermined radius of curvature;

an arcuate plunger of the same radius of curvature as the cylinder, a first end of said plunger mates slidably with the cylinder in such a manner as to trace an arched path corresponding to said predetermined radius of curvature;

a means for urging the plunger in one sliding direction relative to the cylinder, wherein the urging means has a torsion coil spring having a first end engaging a pair of notches formed on the cylinder having a separation of 180 degrees at the first end of the cylinder, and a second end coupled to one end of the plunger;

a passage provided at the first and of the plunger, the passage connecting the interior of the cylinder that is sectioned by the first end of the plunger to the exterior; and a pressure-regulating valve provided in the passage, said valve reduces a cross-sectional area of the passage when the plunger moves in said one sliding direction and increases the cross-sectional area of the passage when the plunger moves in the opposite direction.

2. The damper mechanism of claim 1, wherein the center of curvature of the cylinder and the plunger coincides with the center of rotation of the torsion coil spring.

3. The damper mechanism of claim 1 or 2, wherein the plunger also having formed at the first end thereof a pair of engagement grooves capable of engaging the first end of the torsion coil spring.

4. The damper mechanism of claim 1 or 2, wherein the body of the cylinder and plunger are made of a thermoplastic resin.

5. The damper mechanism of claim 3, wherein the body of the cylinder and the plunger are made of a thermoplastic resin.

* * * * *